US012139320B2

(12) United States Patent
Abt

(10) Patent No.: US 12,139,320 B2
(45) Date of Patent: Nov. 12, 2024

(54) SPRAY HEAD, AND DISPENSER HAVING SUCH A SPRAY HEAD

(71) Applicant: Aptar Radolfzell GmbH, Radolfzell (DE)

(72) Inventor: Andreas Abt, Frickingen (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 413 days.

(21) Appl. No.: 17/480,834

(22) Filed: Sep. 21, 2021

(65) Prior Publication Data

US 2022/0097952 A1 Mar. 31, 2022

(30) Foreign Application Priority Data

Sep. 28, 2020 (EP) ..... 20198823

(51) Int. Cl.
*B65D 83/14* (2006.01)
*B65D 83/20* (2006.01)

(52) U.S. Cl.
CPC ..... *B65D 83/206* (2013.01)

(58) Field of Classification Search
CPC ..... B05B 11/1019; B05B 11/1059; B65D 2215/02; B65D 2215/04; B65D 83/22; B65D 83/40; B65D 83/206
USPC ..... 222/402.11, 402.13, 153.11
See application file for complete search history.

(56) References Cited

U.S. PATENT DOCUMENTS 3,795,366 A * 3/1974 McGhie ..... B65D 83/7532 222/402.11
3,848,778 A * 11/1974 Meshberg ..... B65D 83/205 222/402.11
5,385,303 A * 1/1995 Gosselin ..... B65D 83/205 239/394
6,523,722 B1 * 2/2003 Clark ..... B65D 83/22 222/402.11
8,777,061 B1 * 7/2014 Meshberg ..... B05B 11/1059 222/402.11
8,840,044 B2 * 9/2014 Schmitz ..... B05B 1/1645 239/391
9,216,852 B2 * 12/2015 Cho ..... B65D 83/22
(Continued)

FOREIGN PATENT DOCUMENTS

EP 2707311 B1 3/2014
EP 3287039 A1 2/2018
(Continued)

*Primary Examiner* — Charles P. Cheyney
(74) *Attorney, Agent, or Firm* — FLYNN THIEL, P.C.

(57) ABSTRACT

A liquid discharge head switchable manually between secured and released states. In the secured state, liquid discharge is prevented, and in the released state, liquid discharge is enabled. The discharge head has a discharge channel and a discharge opening at an end of the discharge channel. Further, an outer shell is provided and has a discharge aperture through which the liquid delivered through the discharge opening is discharged. For switching purposes, the outer body has, internally in relation to the outer shell, a rotatable inner or screen body. A releasable snap-action coupling is provided, by which the outer shell and the inner body are coupled rotationally in a closed rotational position such that an open rotational position is reached again only after manual application of force to a release surface of the coupling.

6 Claims, 11 Drawing Sheets

(56) References Cited

U.S. PATENT DOCUMENTS

| | | | | |
|---|---|---|---|---|
| 9,260,237 | B1 * | 2/2016 | Brace | B65D 83/205 |
| 10,589,920 | B2 * | 3/2020 | Fore | B65D 83/48 |
| 11,166,534 | B2 * | 11/2021 | Han | B05B 1/02 |
| 2003/0209569 | A1 * | 11/2003 | Jackson | B65D 83/22<br>222/402.11 |
| 2004/0140324 | A1 * | 7/2004 | Meshberg | B65D 83/70<br>222/402.11 |
| 2005/0017027 | A1 * | 1/2005 | Yerby | B65D 83/46<br>222/402.13 |
| 2007/0235474 | A1 * | 10/2007 | Downey | B65D 83/205<br>222/153.11 |
| 2008/0041889 | A1 * | 2/2008 | Geier | B65D 83/205<br>222/402.11 |
| 2008/0164285 | A1 * | 7/2008 | Hygema | B65D 83/205<br>222/402.11 |
| 2008/0210710 | A1 * | 9/2008 | Marquardt | B65D 83/46<br>222/402.11 |
| 2011/0180570 | A1 * | 7/2011 | Campbell | B65D 83/22<br>222/402.11 |
| 2014/0124539 | A1 * | 5/2014 | Cho | B65D 83/206<br>222/402.11 |
| 2015/0166250 | A1 * | 6/2015 | Brace | B65D 50/00<br>220/288 |

FOREIGN PATENT DOCUMENTS

| | | | |
|---|---|---|---|
| EP | 3453640 | A1 | 3/2019 |
| KR | 200425584 | Y1 | 9/2006 |

* cited by examiner

SPRAY HEAD, AND DISPENSER HAVING SUCH A SPRAY HEAD

CROSS-REFERENCE TO RELATED APPLICATION

This claims priority from European Application No. 20198823.5, filed Sep. 28, 2020, the disclosure of which is hereby incorporated by reference in its entirety.

FIELD OF APPLICATION AND PRIOR ART

The invention relates to a discharge head for discharge of liquids, in particular pharmaceutical liquids or personal care products and also disinfectants and detergents, and to a liquid dispenser having such a discharge head.

A discharge head according to the invention or of the generic type serves for discharge of liquid from a liquid reservoir. For this purpose, it has a discharge channel and a discharge opening at the end of the discharge channel. For the purpose of discharge, the discharge head is preferably depressed in relation to the liquid reservoir. In order to prevent unwanted discharge of liquid, in particular discharge by a child playing with the liquid dispenser, such a discharge head can be switched manually between a secured state and a released state, wherein, in the secured state, discharge of liquid is prevented, and wherein, in the released state, discharge of liquid is enabled.

A generic discharge head has an outer shell with a discharge aperture through which the liquid delivered through the discharge opening can be discharged if the discharge opening and the discharge aperture are arranged in alignment and no screen preventing discharge is provided therebetween. In order to prevent discharge, a generic discharge head has one of two possible configurations. According to a first configuration, it has an inner body on which the discharge opening is provided and which can be rotated relative to the outer shell about a switching axis, wherein the discharge opening, in an open rotational position, is arranged in alignment with the discharge aperture of the outer shell and, in a closed rotational position, is covered by the outer shell. In the case of such a design, it is accordingly thus provided that the prevention or enabling of discharge depends on the relative rotational position of the discharge opening and the discharge aperture. Alternatively, in a second configuration, a generic discharge head has a screen body which is arranged within the outer shell and which can be rotated relative to the outer shell about a switching axis, wherein the screen body has a blocking section which, in a closed rotational position, is arranged between the discharge opening and the discharge aperture in the outer shell and, in an open rotational position, opens up the discharge aperture. In the case of such a design, it is accordingly provided that the discharge opening and the discharge aperture are at all times oriented in alignment and the prevention or enabling of discharge depends on the position of a blocking section which can be positioned therebetween.

Discharge heads of the type described, or of a similar type, are known from the documents EP 2707311 B1 and U.S. Pat. No. 8,777,061 B1.

The invention is directed at increasing security against unwanted discharge, and in the process ensuring in particular a child-proofing function, in the case of a generic dispenser or discharge head.

This is achieved by a discharge head which, in correspondence with the generic discharge head described in the introduction, has an outer shell with a discharge aperture, on the one hand, and has an inner body, or screen body, which is arranged within the outer shell and which can be rotated relative to the outer shell about a switching axis, on the other hand. Here, it matters not whether, during rotation, the outer shell or else the screen body or inner body remains rotationally fixed in relation to a liquid reservoir to which the discharge head is coupled. The discharge opening, which is preferably in the form of a discharge nozzle with a spray opening and/or with a swirl device, in a design with a screen body, is preferably provided so as to be rotationally fixed in relation to the outer shell and, in a design with an inner body, is preferably provided on said inner body and thus so as to be rotatable in relation to the outer shell.

According to one aspect of the invention, provision is made of a releasable snap-action coupling, by means of which the outer shell, on the one hand, and the inner body or the screen body, on the other hand, can be coupled rotationally in the closed rotational position such that the open rotational position can be reached again only after manual application of force to a release surface of the releasable snap-action coupling.

In this context, a snap-action coupling is to be understood as being a coupling device which, during the relative rotation of the inner body or screen body in relation to the outer shell, abruptly assumes a coupled state upon the reaching of a closed rotational position by way of a mechanical relief of load of a previously preloaded latching section, which coupled state cannot be exited again by an opposite application of moment alone. If the discharge head has been brought into said closed state, preferably radial and/or axial application of force to the release surface is required to elastically deflect the stated latching section again such that a reverse rotation in the direction of the open rotational position can subsequently be achieved. Preferably, the snap-action coupling is configured in such a way that, upon the reaching of the closed rotational position and also/or else upon the reaching of the open rotational position, an audible noise is generated, so that the user can detect the reaching of the respective end position acoustically, and possibly also haptically.

According to the first-mentioned configuration, it is provided that the discharge is enabled and prevented by the relative rotatability of the inner body, and thus of the discharge opening, in relation to the outer shell. Here, it is preferably provided that the inner body has an outer encircling shell section and a line section which is connected integrally thereto and which projects into an inner region of the shell section and which is passed through by the discharge channel. Both designs in which the outer shell remains rotationally fixed in relation to the liquid reservoir by means of a corresponding coupling device and the inner body, by contrast, is rotatable about the switching axis, and designs in which the inner body remains rotationally fixed in relation to the liquid reservoir by way of a coupling device and the inner body, by contrast, is rotatable about the switching axis are possible.

Here, the shell section preferably bears those elements of the snap-action coupling which are provided on the inner body. Furthermore, in the case of an inner body rotatable in relation to the liquid reservoir, provision is made on the shell section preferably of a grip surface for the purpose of manual rotation of the inner body in relation to the outer shell. The line section projects into an inner region and, with the discharge channel, comprises the feed line to the discharge opening. The discharge opening may be provided integrally on the inner body or, in a manner explained in more detail below, be formed by a separate component.

In the case of an outer shell rotatable in relation to the liquid reservoir, said outer shell preferably has at least one grip surface for facilitated handling, in particular having a structuring such as for example a corrugation.

With the exception of the components associated directly with the snap-action coupling, the shell section is preferably configured to be rotatable in relation to the outer shell only, while the line section is configured to be additionally depressible. For the purpose of the limited mobility of the line section, provision is preferably made of a deformable attachment region which acts as a kind of joint and which is provided between the shell section and the line section. The attachment region is preferably formed by at least one thin-walled plastic bridge which, when depression occurs, is deformed elastically.

The line section is preferably configured for being coupled directly to a valve tube of a pressure reservoir and, for this purpose, has a liquid inlet which is aligned with the switching axis. The valve tube is preferably pushed into this. Axial displacement of the liquid inlet leads to inward pressing of the valve tube and thus to opening of the valve.

The line section may be directly accessible externally, so that depression may be realized by direct application of force to a top side of the line section. A design in which the outer shell has the depressible manual actuation means, in particular in the form of an actuation surface which is arranged on the top side and which can be pressed in downwards, is advantageous, however. This acts indirectly on the line section. The line section is therefore subjected to downward force by the manual actuation means of the outer shell.

In the second stated configuration, it is provided that provision is made of a screen body which, in a manner dependent on its rotational position relative to the outer shell, is arranged between the discharge opening and the discharge aperture and, there, can prevent liquid discharge. In such a design, the screen body is preferably provided with an outer encircling shell section which, unlike the first configuration, cannot be rotated together with the discharge opening. Instead, in this configuration, the discharge opening is preferably provided so as to be rotationally fixed in relation to the outer shell and to a discharge aperture provided therein. It is in particular preferably the case that, for this purpose, provision is made integrally of a line section on the component forming the outer shell. Said line section, like the above-mentioned line section in the first configuration, is passed through by the discharge channel, which supplies the discharge opening with liquid. As already described, the discharge opening may be defined integrally in the line section or may be formed by a separate component.

In this second configuration, a depressible manual actuation means is preferably provided on the outer shell. The line section is preferably connected integrally to the manual actuation means. Preferably, this line section also has a liquid inlet which is aligned with the switching axis and acts, in a manner described above, on a valve tube of the liquid reservoir.

The snap-action coupling is configured for coupling to one another, in the closed rotational position, the inner body, in the case of the first configuration, or the screen body, in the case of the second configuration, on the one hand, and the outer shell, on the other hand, in such a way that an application of moment in the direction of the open rotational position alone is not sufficient for exiting the closed rotational position. In order to re-establish the rotatability, an additional application of force to the release surface must be realized. The coupling in the closed position is achieved in particular in a form-fitting manner, preferably by latching in a primarily radial direction in relation to the switching axis. In principle, however, part or partial, or full axial latching, is also possible.

The latching is realized in that a section which is deflected elastically from its basic position during the movement into the closed rotational position snaps into a cutout of a retaining profiling or into a retaining aperture so as to form the stated form fit. The elastically deflected section may be provided on the outer shell and/or on the inner body or screen body.

In a preferred design, the snap-action coupling is formed by a latching extension which projects outwardly from the inner body or from the screen body and which can be deflected elastically radially inwardly, and by a corresponding retaining aperture or retaining profiling on the outer shell.

Here, the release surface is preferably formed by a face surface of the stated latching extension, so that a separate release surface may be dispensed with. The latching extension is accordingly manually subjected to load directly in order to disengage it from the stated retaining cutout or retaining aperture so that the open rotational position can subsequently be reached again. Designs in which the release surface is separated from the latching extension and indirectly applies force to the latter are also possible, however.

A particularly advantageous design provides that the retaining aperture or retaining cutout into which the latching extension springs upon the reaching of the closed rotational position is formed by the discharge aperture itself. In order to reach the open rotational position proceeding from the closed rotational position, the user consequently firstly presses onto the latching extension arranged in the discharge aperture, such that said latching extension is pressed inward out of the discharge aperture. Subsequently, the rotational movement into the open rotational position is possible.

The retaining aperture or retaining profiling may however also be provided so as to be separated from the discharge aperture, in particular on that side of the outer shell which faces away from the discharge aperture.

The latching extension is preferably provided on a radially deflectable surface section which is provided via a tangentially oriented deformation region on an adjacent section of the inner body or of the screen body.

In order that the latching extension, upon the reaching of the closed rotational position, snaps into the corresponding retaining aperture or retaining profiling, it must be elastically preloaded beforehand. One possibility for this is for the latching extension to be elastically preloaded at all times when it is not snapped in in the closed rotational position. However, this is associated with the risk of the elasticity being reduced over time owing to relaxation. It is therefore preferable for the latching extension to also be relieved of load, at least partially, in the open rotational position and, during a rotational movement in the direction of the closed rotational position, to be loaded prior to the reaching of the closed rotational position. In order to achieve this, provision is preferably made on an inner side of the outer shell or on an outer side of the inner body or of the screen body and/or on the latching extension of an insertion bevel, by means of which the latching extension is deflected elastically, in particular is deflected radially inwardly or outwardly, when the inner body or the screen body is moved relative to the outer shell in the direction of the closed rotational position.

Preferably, a securement of the outer shell to the inner body or to the screen body is provided not only in the closed rotational position but also in the open position. However, whereas the securement in the closed rotational position cannot be overcome by a rotational movement alone, the securement in the open rotational position can preferably be overcome solely by a rotational movement counter to an increased resistance moment. Preferably, for this purpose, the screen body or the inner body and the outer shell have interacting retaining means which, in the open rotational position, bring about the securing of the rotational position. The stated latching extension, which is also part of the snap-action coupling, is preferably also part of these retaining means. It is in particular preferable for said latching extension, upon the reaching of the open rotational position, to spring into a recess and to thus generate an audible noise, which is interpreted by the user as confirmation of the reaching of the open rotational position.

The described securement in the open rotational position lowers the risk of an erroneous discharge, which could occur if the outer shell and the inner body/screen body are undesirably in a position which is a few degrees away from the open rotational position.

Both of the stated configurations, with the inner body and the screen body, respectively, have the effect that the discharge opening is visible through the discharge aperture of the outer shell in the open rotational position and is not visible in the closed rotational position, either because, in the closed rotational position, the discharge opening is arranged offset from the discharge aperture (first configuration with inner body) or because the blocking section of the screen body is arranged between the discharge opening and the discharge aperture (second configuration with screen body).

This is preferably also used to make it quickly apparent to the user, by means of a colour coding, which rotational position the discharge head is presently in. For this purpose, it is preferably provided that the discharge opening is formed by a discharge opening component, such as in particular a nozzle component, wherein the discharge opening component is coloured differently from the inner body or the screen body. In this regard, it is possible in particular for the discharge opening component to be green and for the inner body or the screen body to be red. In the open rotational position, the discharge opening component can be seen through the discharge aperture and, with the green colour, signals readiness for discharge. In the closed rotational position, only the inner body or the screen body can be seen through the discharge aperture, which inner body or screen body signals, with its red colour, that the discharge head is presently blocked.

In a discharge head according to one aspect of the invention, it is provided that, in the closed rotational position, discharge is prevented at least in that liquid discharged through the discharge opening cannot escape through the discharge aperture, either because the discharge opening and the discharge aperture are not oriented in alignment (first configuration) or because a screen is arranged between the two (second configuration).

Preferably, however, it is provided that the rotation into the closed rotational position also prevents discharge in an additional manner.

In particular preferably, it may for this purpose be provided that the inner body or the screen body is matched to the outer shell in such a way that, in the closed rotational position, depression of a manual actuation means or member of the outer shell is blocked. This may be realized in particular in that, in the closed rotational position, the line section is arranged above a blocking section, which acts as a stop and in this way prevents the depression of the line section.

A further way of preventing discharge, or making discharge more difficult, in the closed rotational position can be achieved in that the outer shell has on the side which faces away from the discharge aperture a cut-away region for lateral accessibility of a manual actuation means or member, and the inner body or the screen body likewise has a cut-away region for lateral accessibility of the manual actuation means. In the open rotational position, the cut-away regions are arranged in an overlapping manner such that lateral accessibility of the manual actuation means is provided and depression is easy with a finger arranged laterally on the discharge head. In the closed rotational position, by contrast, the cut-away regions are arranged offset from one another such that lateral accessibility is impeded. Even if, considered in isolation, this does not reliably prevent actuation, it makes it clear to the user that discharge in the closed rotational position is not as intended.

As described, it is provided that, for the purpose of switching, the inner body or the screen body is rotated in relation to the outer shell about the switching axis. Although, for the functioning described, it is unimportant which of the components remains rotationally fixed in relation to a liquid reservoir, it is considered to be preferable for the outer shell to be fastened rotationally conjointly in a form- or force-fitting manner to a liquid reservoir, so that, for the purpose of the rotation, said liquid reservoir can be held, on the one hand, and the inner body or the screen body can, by contrast, be rotated, on the other hand.

Preferably, the manual application of force to the inner body or to the screen body in the direction of rotation is realized by means of a grip surface provided thereon, which is of non-slip form in particular by way of structuring of the surface. In the case of latching of the latching extension by way of a retaining profiling, it may be advantageous for the grip surface to be provided directly on the latching extension. If, however, provision is made of a retaining aperture by way of which the latching extension is latched as intended, then the grip surface for rotation of the inner body or of the screen body is preferably provided so as to be separated from the latching extension and/or the release surface and is preferably provided so as to be situated opposite the release surface. The oppositely situated arrangement makes it particularly difficult for children to simultaneously apply a force to the release surface and the grip surface for the purpose of transfer into the open rotational position.

Beside the discharge head itself, one aspect of the invention also relates to a liquid dispenser having such a discharge head. Said liquid dispenser has, beside the discharge head, a liquid reservoir to which the discharge head is fastened.

Such a dispenser may be configured in particular for discharge of pharmaceutical liquids or personal care products and also disinfectants and detergents and, in the ready-to-use state, has a liquid reservoir which is filled with such a liquid.

In particular preferably, the liquid reservoir is in the form of a pressure reservoir, that is to say is already pressurized, for example by way of compressed air or a propellant, prior to being put into service. In particular preferably, the liquid reservoir has an outlet valve which can be actuated by means of the inner body or by a line or conveying section attached to the outer shell. For this purpose, the outlet valve preferably has a depressible valve tube which opens the outlet valve by way of depression. Said valve tube is preferably inserted into the above-described liquid inlet of the line section and is depressible by the conveying section.

Due to its secured closed rotational position, the discharge head as described makes unwanted discharge of liquid more difficult, in particular if a dispenser having such a discharge head ends up in children's hands. However, such child-proofing is sufficiently reliable only if the removal of the discharge head in its entirety from the liquid reservoir is also made more difficult.

Both designs in which the outer shell component is connected rotationally conjointly to the liquid reservoir and designs in which the inner body is connected rotationally conjointly to the liquid reservoir are possible. In this context, rotationally conjointly is to be understood as meaning that the connection is maintained in a form- or force-fitting manner rotationally, and that the resistance of the rotation of the outer shell component or of the inner body in relation to the liquid reservoir is greater than the resistance in relation to the outer shell component or to the inner body for the part intended to be rotatable. Preferably, it is therefore provided that the discharge head and in particular the outer shell thereof is connected to the liquid reservoir in such a way that a separating force of 100 newtons is not sufficient to pull the discharge head off from the liquid reservoir. In particular, the connection which ensures this may be a snap-action connection. In particular, it may also be expedient for the connection to be configured in such a way that it cannot be released in a non-destructive manner. In such a case, separation of discharge head and liquid reservoir is possible only destructively, in particular in that retaining sections of the discharge head are deformed or broken. This is normally possible only by a use of force which at least toddlers are incapable of applying.

BRIEF DESCRIPTION OF THE DRAWINGS

Further advantages and aspects of the invention emerge from the claims and from the following description of preferred exemplary embodiments of the invention, which are discussed below on the basis of the figures.

DETAILED DESCRIPTION OF THE EXEMPLARY EMBODIMENTS

Figure 1:
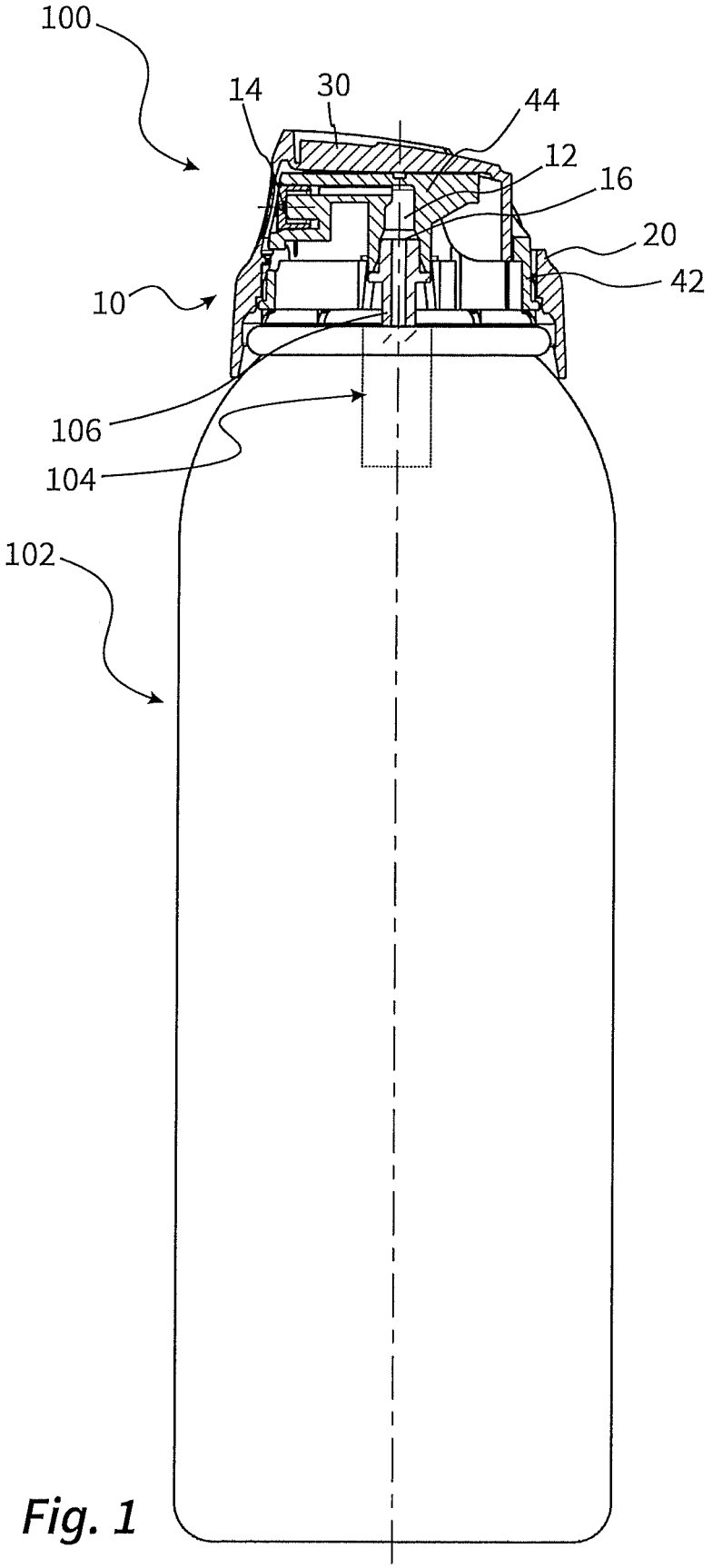
FIG. 1 shows a liquid dispenser according to the invention with a discharge head in an overall illustration.

FIG. 1 shows a liquid dispenser 100 according to the invention in an overall illustration.

The liquid dispenser 100 has a liquid reservoir 102, which in the present case is in the form of a pressure reservoir, in which a pharmaceutical liquid or a personal care product is stored under pressure. The liquid reservoir 102 is closed off by a crimped cover. It has an outlet valve 104 with a valve tube 106. Depressing said valve tube 106, downwards in relation to FIG. 1, allows the outlet valve 104 to be opened so that liquid flows into a discharge head 10 through the valve tube 106, which discharge head is fastened to the crimped cover by means of a latching connection.

The discharge head 10 has a liquid inlet 16 which is pushed onto the valve tube 106. Proceeding from the liquid inlet 16, a discharge channel 12 extends as far as a discharge opening 14, which is preferably in the form of a spray opening and may be provided with an upstream swirl chamber so as to bring about the swirling of the exiting fluid and thus the generation of a spray jet.

A line or conveying section 44 of the discharge head 10 can be depressed downwards from above by manual application of force. This also depresses the liquid inlet 16, which consequently presses the valve tube 106 downwards and in this way opens the outlet valve 104.

The design of the discharge head 10, which is illustrated merely by way of example in FIG. 1, is illustrated in more detail in the other figures.

In the configuration in FIGS. 2 to 7D, the discharge head 10 has an outer shell component 20 and an inner body 40 which is inserted therein. Additionally, there is provided a discharge opening component 90, which is inserted into a corresponding cutout of the inner body 40.

The outer shell component 20 is provided for latching fastening to the liquid reservoir 102. A coupling collar 21, on which collar 21 coupling devices provided for this fastening are provided on the inner side, remains positionally fixed in relation to the liquid store 102 at all times during operation and can be detached from the latter only upon application of a large pulling force, and preferably not in a non-destructive manner. Extending upwards from the coupling collar 21 is a lateral section 23, which is not a complete circle and is passed through by a discharge aperture 22. A manual actuation means or member 30, such as a button, is formed integrally on the inner side of said lateral section 23. The manual actuation means is fastened to the lateral section 23 merely by a narrow bridge, and in this way is able to be depressed elastically in relation to the lateral section 23.

The inner body 40 already mentioned is inserted into the outer shell component 20. Said inner body 40 has an outer-side encircling shell section 42 and the line or conveying section 44 which is connected integrally thereto. The already-described components of the liquid inlet 16, the discharge channel 12 and the receiving part for the discharge opening component 90 are provided in said line section 44. The line section 44 is formed integrally on a part-section which, in relation to the surrounding sections of the shell section 42, can be depressed by elastic deformation such that a force acting on the manual actuation means 30 is transferred to the line section 44 and, for its part, the line section 44 can depress the valve tube 106 for opening the valve.

On the shell section 42 of the inner body 40, there is furthermore provided a latching extension 66, which, due to cut-away portions, can likewise be deflected in relation to adjacent part-sections of the shell section 42. Said latching extension 66 has a face surface 62, which, in a manner described in more detail below, at the same time constitutes a release surface 62. Said release surface 62 is provided on one side with an insertion bevel 64. The shell section 42 furthermore has, approximately opposite the latching extension 66, a grip surface 48, the use of which will be described in more detail below.

In the mounted state, which is illustrated in FIGS. 2 to 5, the inner body 40 is inserted into the outer shell component 20 from below and can be moved so as to rotate about a switching axis 2 therein. With the exception of the part-sections 66, 44, 30, which are provided on these two components so as to be movable in a limited manner, the outer shell component 20 and the inner body 40 can be moved in relation to one another purely in a manner rotatable about the switching axis 2. They have corresponding guide surfaces for this purpose.

Figure 2:
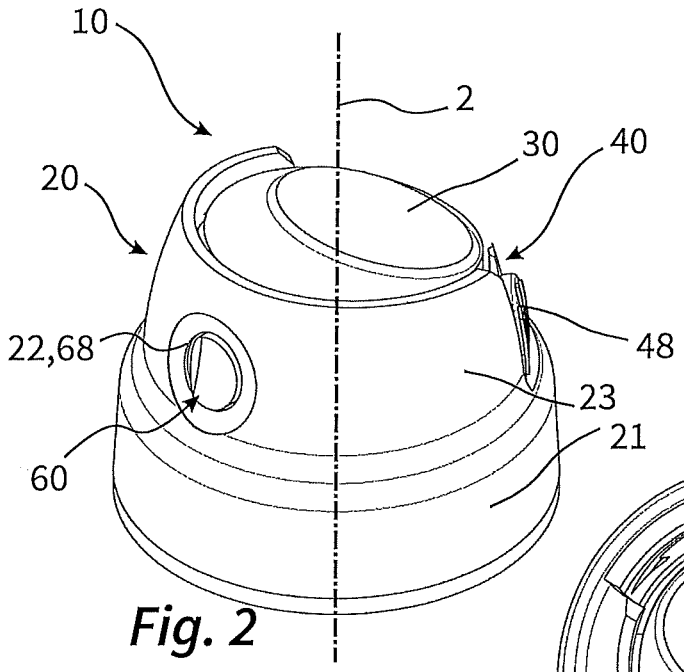
FIGS. 2 to 5 show a first variant of the discharge head in a secured closed state (FIGS. 2 and 3) and in an open state (FIGS. 4 and 5).
Figure 3:
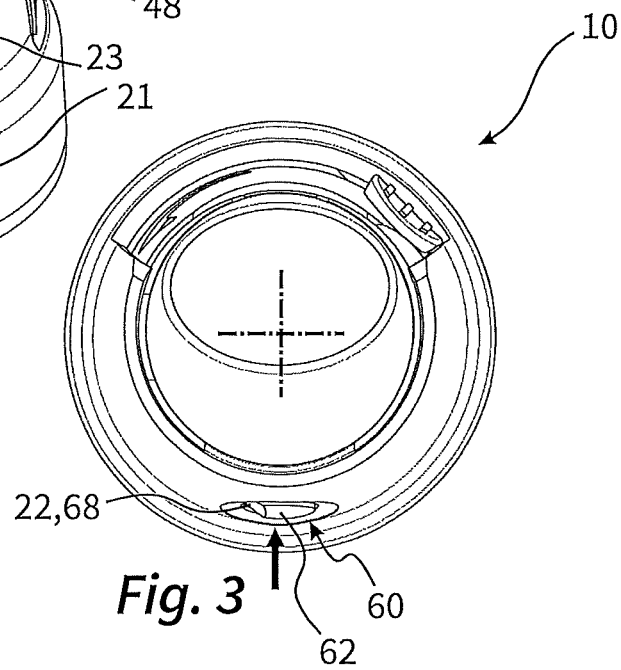

FIGS. 2 and 3 illustrate a closed state of the discharge head 10. In said closed state, the inner body 40 and the outer shell component 20 are in a closed rotational position relative to one another. In said closed rotational position, the latching extension 66 is arranged within the discharge aperture 22, which in this way forms a retaining aperture 68 of a snap-action coupling 60. As can be seen from FIG. 6, which shows the same rotational position of the inner body 40 in relation to the outer shell component 20, in this position, the discharge opening 14 is arranged not in alignment with the discharge aperture 22, so that, for this reason alone, discharge is not possible. Additionally, discharge in this position is made more difficult in that depression of the manual actuation means 30 is blocked by a blocking section 41 of the inner body 40. Moreover, in the closed state in FIGS. 2 and 3, a cut-away region 46 in the inner body 40 is offset by 90° in relation to a corresponding cut-away region 26 of the outer shell component 20, so that it is perfectly clear to a user that actuation is not intended to take place in this rotational position.

Figure 4:
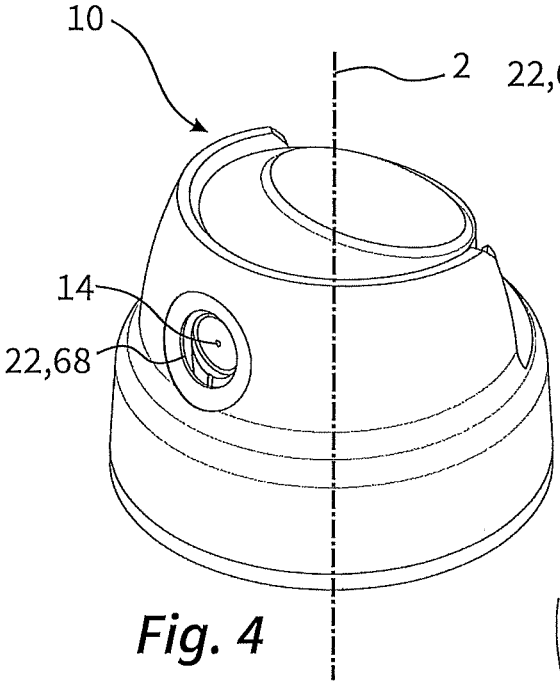
Figure 5:
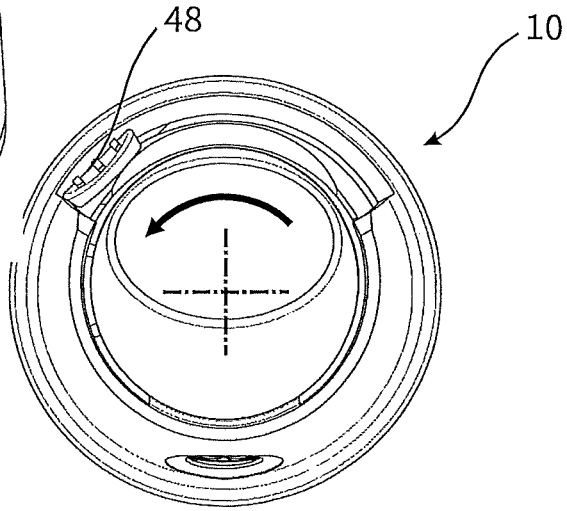
Figure 6:
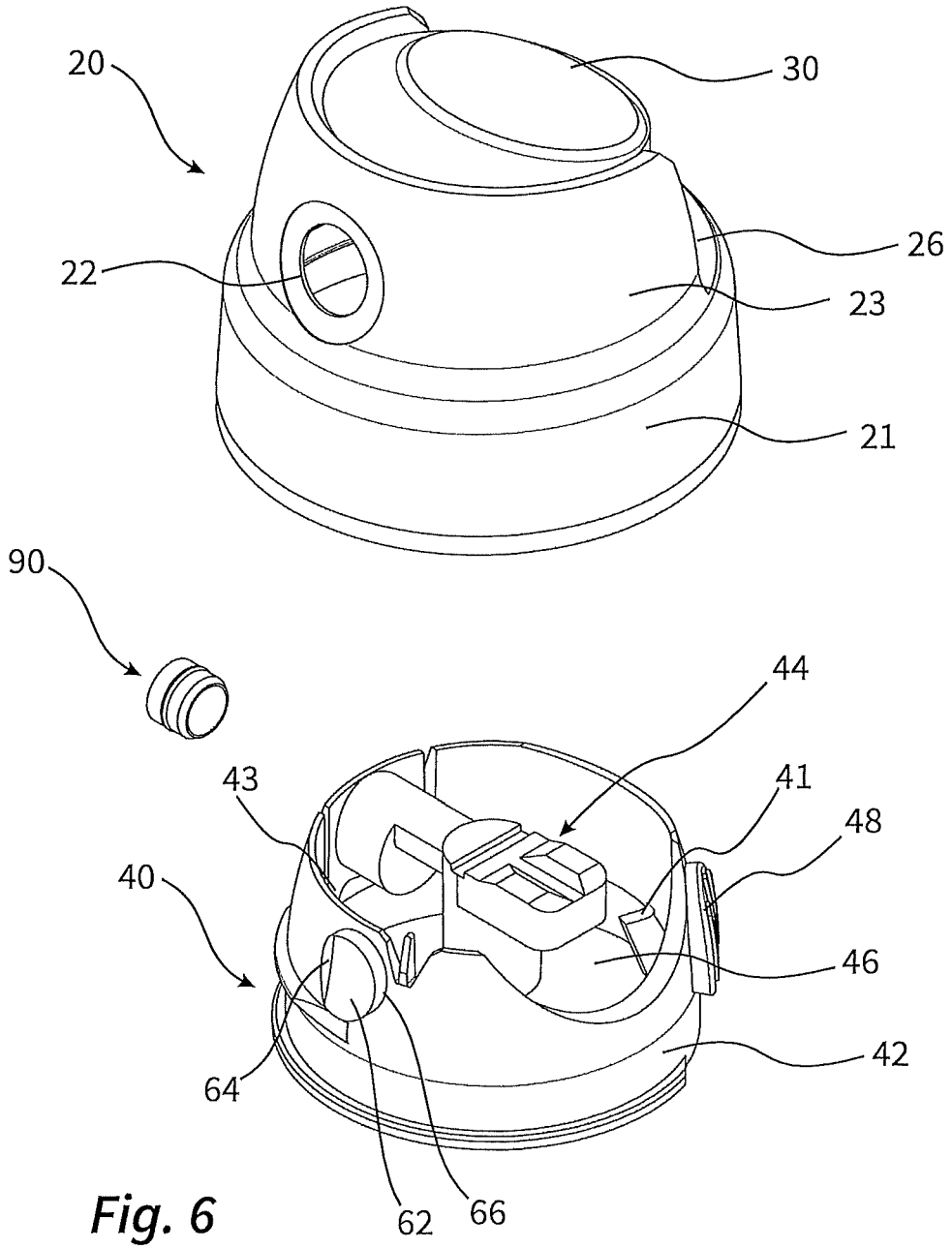
FIG. 6 shows the components of the discharge head in FIGS. 2 to 5 in a separate illustration.

In order to transfer the discharge head into an open state, in which discharge is subsequently possible by actuation of the manual actuation means 30, the inner body 40 has to be rotated anticlockwise through approximately 90° in relation to the outer shell component 20. However, this is only possible when, for this purpose, the latching extension 66 has been disengaged from the discharge aperture 22 by direct manual application of force to the release surface 62 of said latching extension. This is illustrated by an arrow in FIG. 3. It is therefore provided that, with reference to FIG. 2, the user presses the latching extension 66 radially inwards and, in this state, performs the relative rotation, which is illustrated by an arrow in FIG. 5. The grip surface 48 already described is provided for the purpose of aiding the relative rotation, said grip surface being displaced anticlockwise by the user. The latching extension 66 is consequently removed from the discharge aperture 22, while the discharge opening 14 is brought into a position of alignment with the discharge aperture 22. FIGS. 4 and 5 show the open state thus reached. In this state, liquid discharge is then possible by depression of the manual actuation means 30. The depression also indirectly brings about a depression of the line section 44 of the inner body 40, and thus a depression of the valve tube 106.

If, after the use, the intention is for the discharge head 10 to be returned to its secured closed state, then the grip surface 48 is rotated clockwise. During the transfer, the latching extension 66 is pressed, by means of its insertion bevel 64, radially inwards by the inner side of the outer shell component 20 until it snaps, in the region of the discharge aperture 22, back into the latter. Consequently, the secured initial state in FIGS. 2 and 3 is achieved again.

Figure 7A:
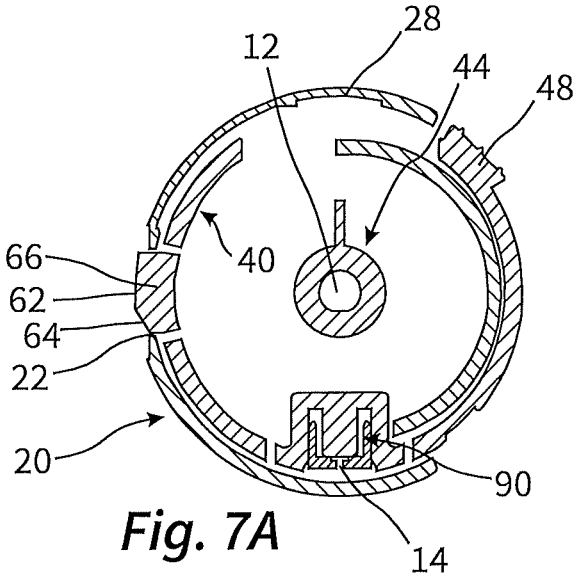
FIGS. 7A to 7D show the discharge head in FIGS. 2 to 6 in a sectioned illustration during the transition from the closed state into the open state.
Figure 7B:
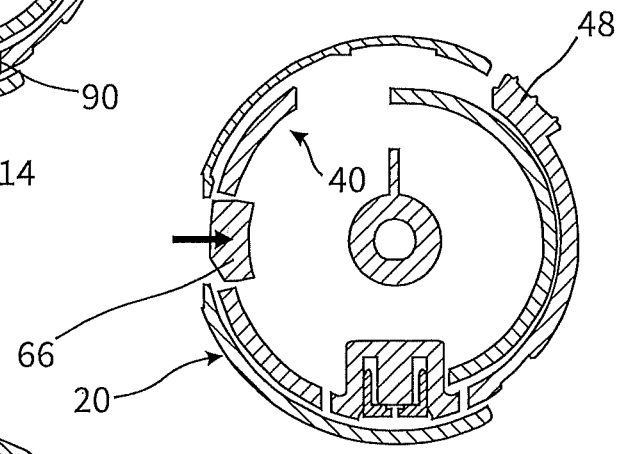
Figure 7C:
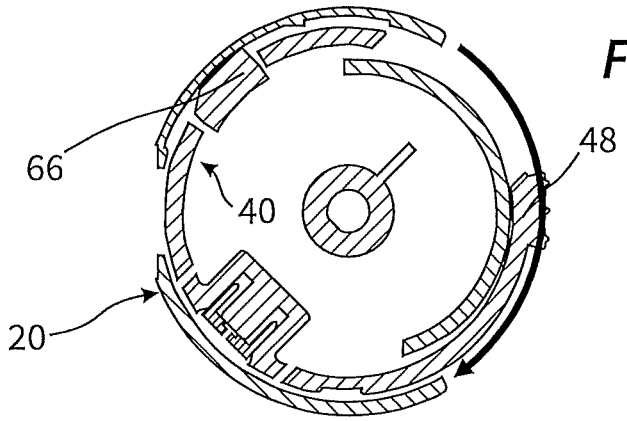
Figure 7D:
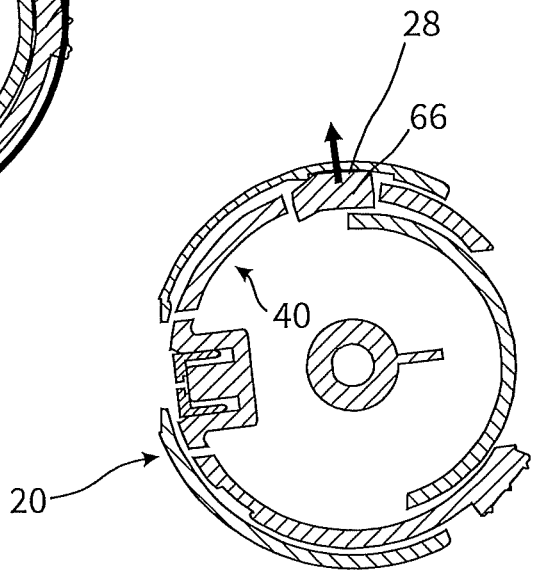
Figure 8:
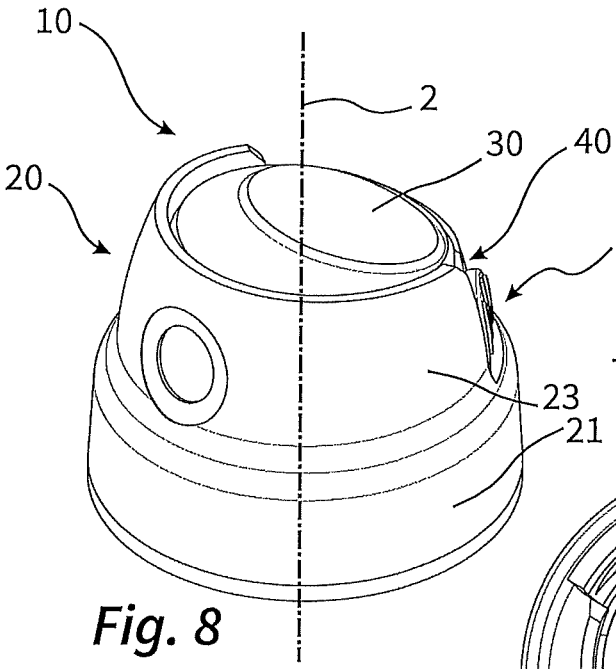
FIGS. 8 to 11 show a second variant of the discharge head in a secured closed state (FIGS. 8 and 9) and in an open state (FIGS. 10 and 11).

The sectional illustrations in FIGS. 7A to 7D once again illustrate the transfer from the closed rotational position in FIG. 7A, corresponding to FIGS. 2 and 3, into the open rotational position in FIG. 7D, corresponding to FIGS. 4 and 5. Proceeding from the closed rotational position, the latching extension 66 is manually pressed inwards out of the discharge aperture 22, as illustrated by the arrow in FIG. 7B. While the latching extension 66 is still being manually pressed inwards, the user begins with the rotational movement by applying force to the grip surface 48, as illustrated in FIG. 7C. Upon reaching the open rotational position, the latching extension 66 snaps into an inner-side recess 28 of the outer shell component 20. This causes a noise and signals to the user that the rotational movement has been realized to a sufficient extent. Moreover, the engagement of the latching extension 66 into the recess 28 also leads to a securing action against an excessively simple exiting of the open state.

The configuration in FIGS. 8 to 12 is largely similar to the preceding exemplary embodiment. The differences will be explained below. Otherwise, the features as described in relation to the embodiment of FIGS. 2 to 7D apply.

Figure 9:
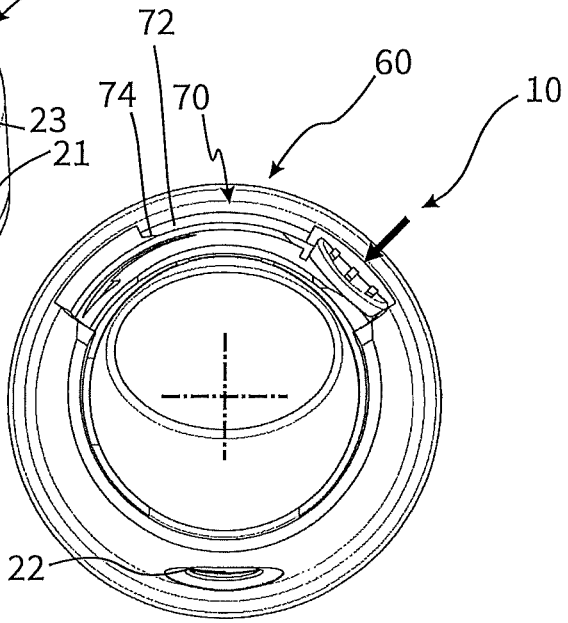
Figure 10:
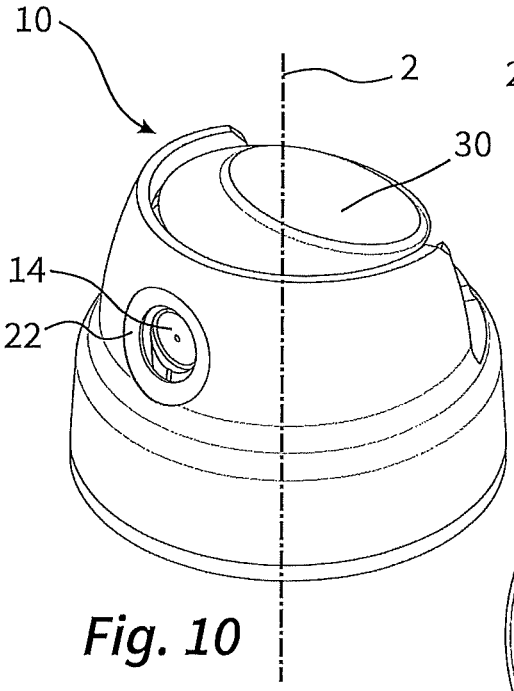
Figure 11:
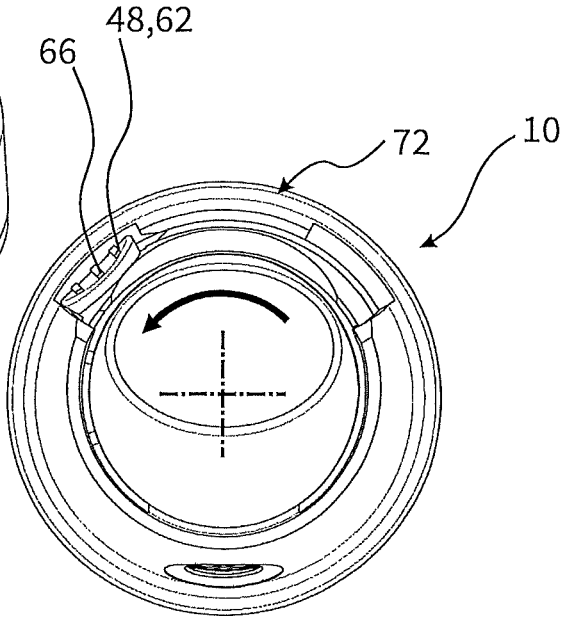

The discharge head 10 as per FIGS. 8 to 12 likewise has an outer shell component 20 and an inner body 40. By contrast to the above-described design, however, provision is not made of a latching extension which, in the closed state, projects into the discharge aperture 22. Instead, a section on which the grip surface 48 is provided simultaneously forms the latching extension 66 and the face surface 62 thereof. In order for a snap-action coupling 60 to be formed by way of said section, a retaining profiling 70 is provided in the cut-away region 26 of the outer shell component 20. In the secured closed state in FIGS. 8 and 9, the latching extension 66 is positioned radially at the outside to such an extent that a rotational movement in the direction of an open rotational position is prevented by a crenellation 72 of the retaining profiling 70. Only when the latching extension 66 has been pressed in by radial application of force to the grip surface 48 is it possible, by means of the same grip surface and a then tangential additional application of force, for the rotational movement from the closed state in FIGS. 8 and 9 into the open state in FIGS. 10 and 11 to be brought about. The arrows in FIGS. 9 and 11 illustrate the pressing-in and the rotation.

The opposite movement into the secured state is again facilitated by an insertion bevel 74, which in this case is provided not on the latching extension 66 but on the crenellation 72.

In this second configuration, the secured state is secured almost to the same extent as in the first configuration as far as the prevention of inadvertent opening, for example when the liquid dispenser is stored in luggage, is concerned. With regard to child-proofing, however, the exemplary embodiment in FIGS. 2 to 7D is more suitable since, due to the required simultaneous application of force to the elements of the latching extension 66 and the grip surface 48, which are arranged opposite one another there, it is difficult for the open rotational position to be reached by children. However, with a suitable design of the retaining profiling 70 and of the latching extension 66 in the exemplary embodiment in FIGS. 8 to 12, actuation by children is at least made significantly more difficult, in particular if the pressing-in of the grip surface for the purpose of releasing the snap-action connection requires an actuation force above 20 N.

FIGS. 13 to 16 show an alternative design. In correspondence with the preceding exemplary embodiments, provision is also made here of an outer shell component 20 having a discharge aperture 22 through which liquid which has been delivered beforehand through the discharge opening 14 situated behind the aperture 22 can be discharged. By contrast to the aforementioned exemplary embodiments, in the exemplary embodiment in FIGS. 13 to 16, provision is made however not of an inner body with a line section but of a screen body 50 which, in a manner similar to the above-described inner body, is coupled, in a manner rotatable in relation to the outer shell component 20 about a switching axis 2, to said outer shell component.

In this design, the line section with the discharge opening 14 is provided not so as to be rotationally movable in relation to the outer shell component 20, but in such a way that the discharge opening 14 is at all times aligned with the discharge aperture 22. In order nevertheless to be able to prevent a discharge, the screen body 50, in the closed rotational position in FIGS. 13 and 14, closes off the discharge aperture 22 by means of a blocking section 52. For this purpose, a gap is provided between the inner side of the discharge aperture 22 and the discharge opening 14.

The screen body 50 is secured on the outer shell component 20 in the closed rotational position in the same manner as the inner body 40 of the exemplary embodiment in FIGS. 8 to 12, specifically, by way of a latching extension 66 whose face surface 62 forms a grip surface 48.

Figure 12:
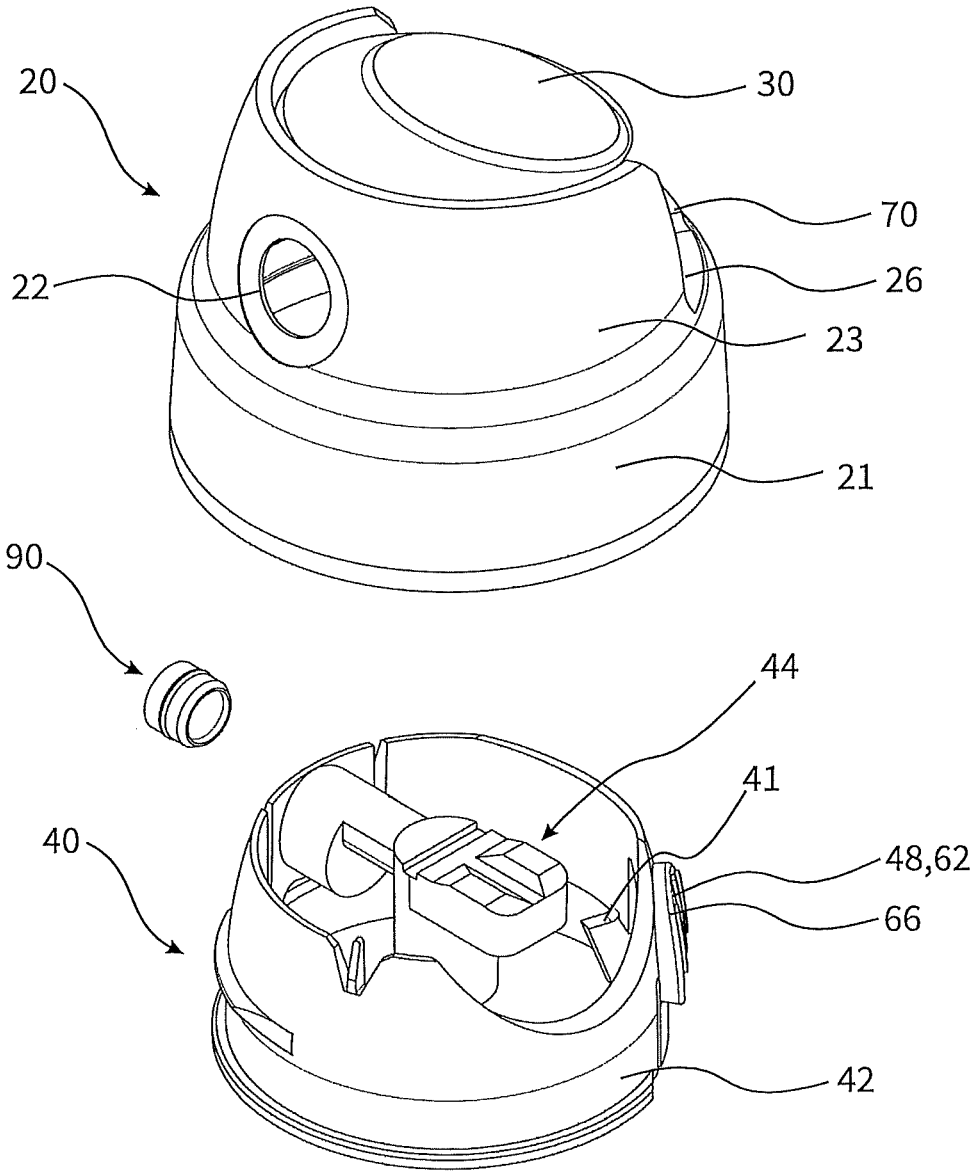
FIG. 12 shows the components of the discharge head in FIGS. 8 to 11 in a separate illustration.
Figure 13:
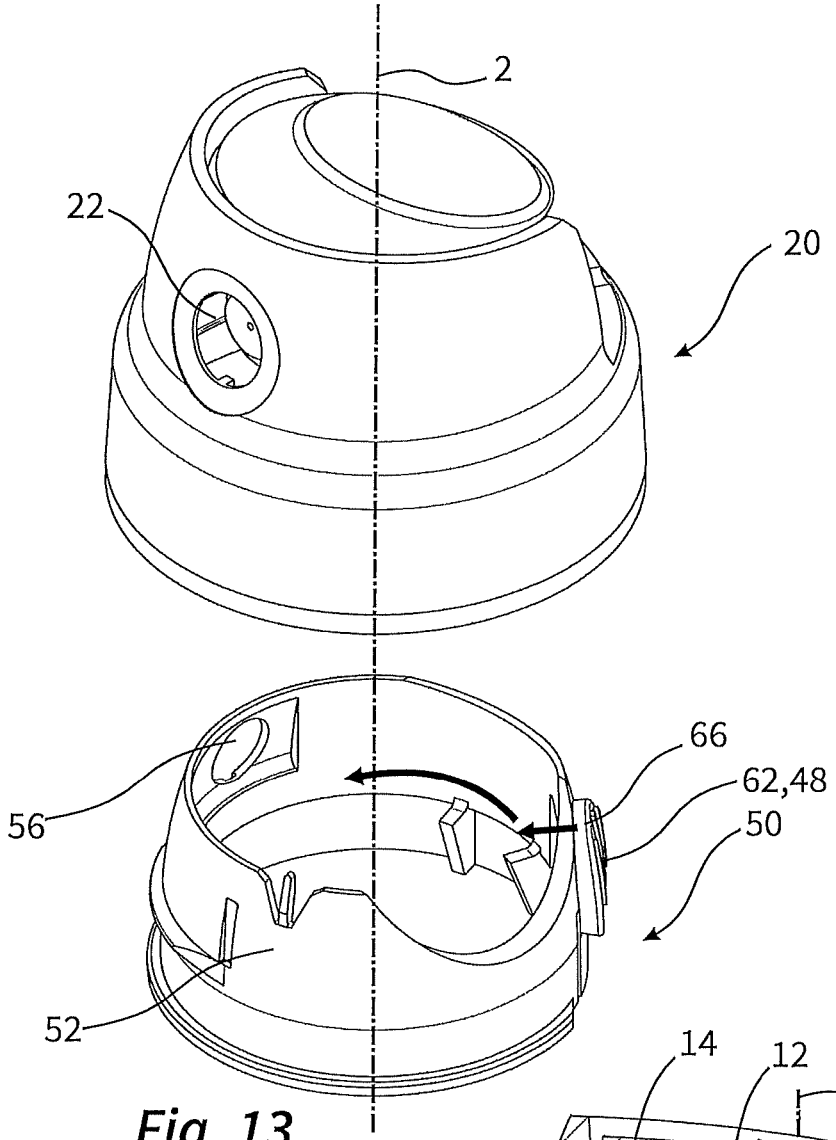
FIGS. 13 to 16 show a third variant of the discharge head in a secured closed state (FIGS. 13 and 14) and in an open state (FIGS. 15 and 16).
Figure 14:
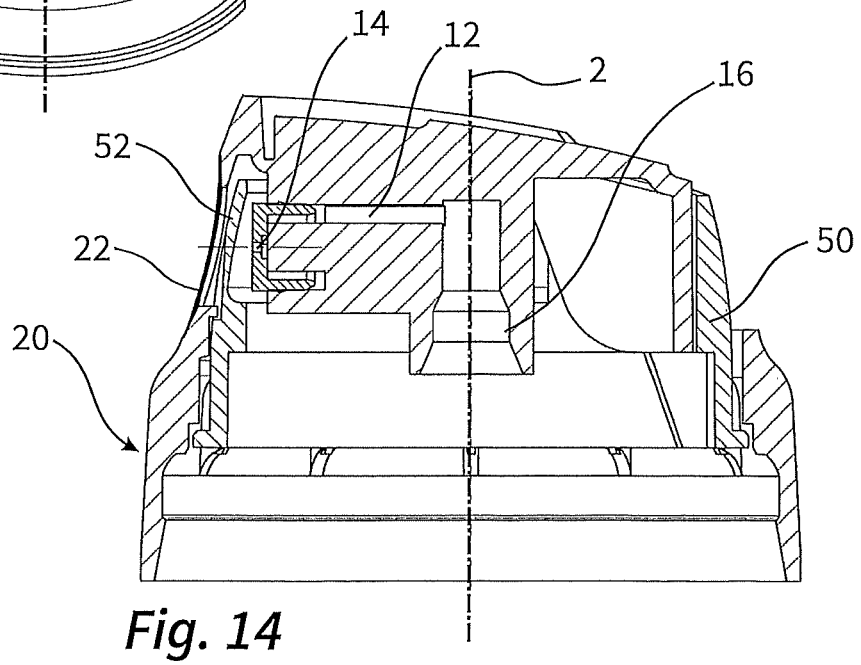
Figure 15:
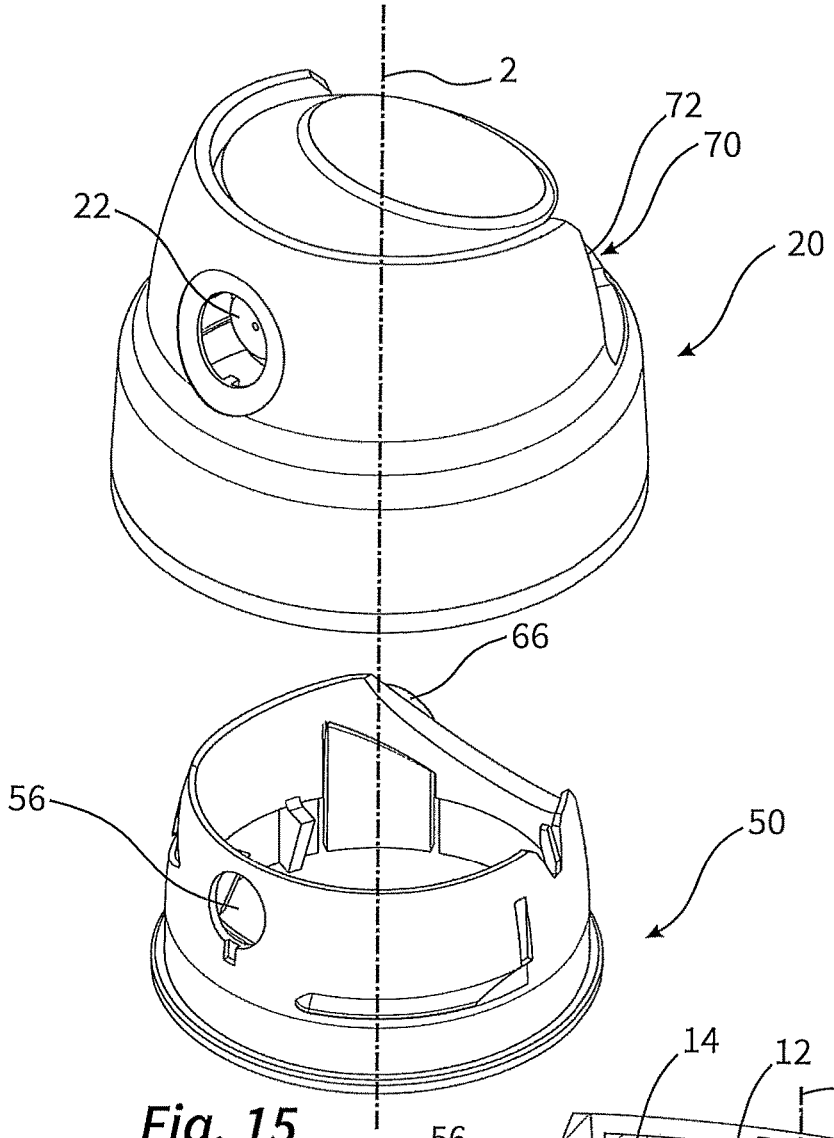
Figure 16:
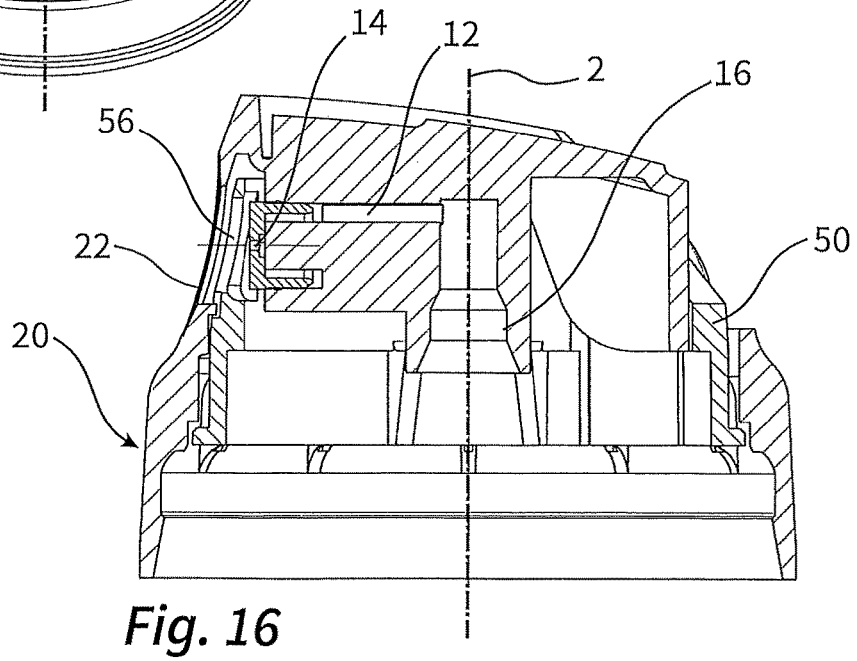
Figure 17:
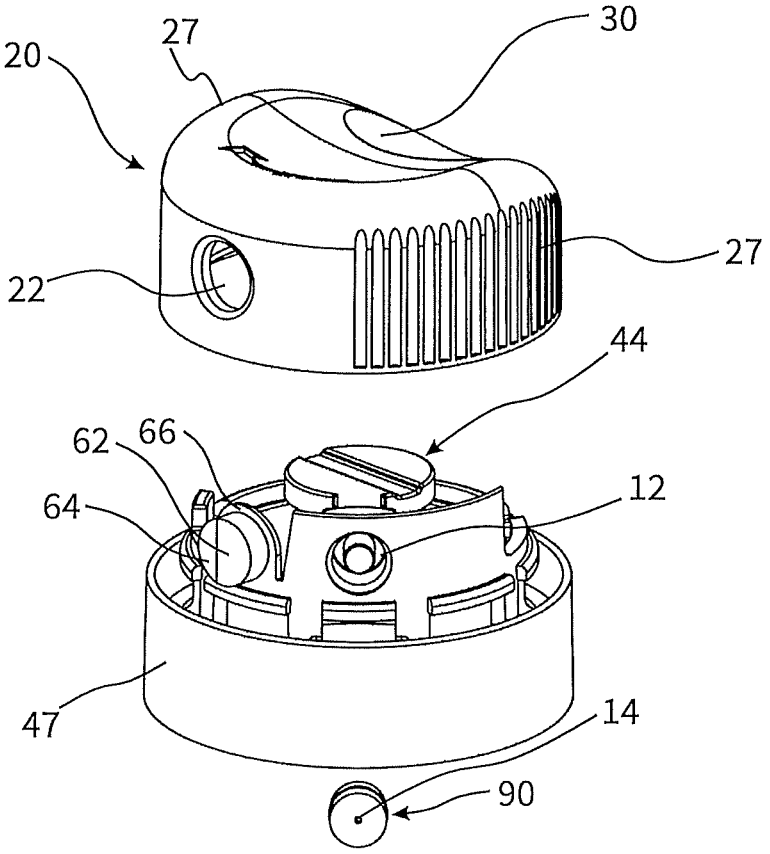
FIGS. 17 to 22 show a fourth variant of the discharge head.

In order to bring the discharge head 10 from its closed rotational position in FIGS. 12 and 13 into its open rotational position in FIGS. 14 and 15, it is again necessary for the latching extension 66 to be displaced by radial application of force to the release surface 62 thereof in such a way that the latching extension 66 can subsequently be guided past the crenellation 72 of the retaining profiling 70. The arrows in FIG. 13 illustrate this. By way of said movement, a cutout 56 of the screen body 50 passes between the discharge opening 14 and the discharge aperture 22, so that discharge is possible through said aperture in the open rotational position.

FIGS. 17 to 22 show a further exemplary embodiment of a discharge head 10 according to the invention. This is similar to the design in FIGS. 2 to 7D. In correspondence with the stated design, the discharge head has an outer shell component 20 and an inner body 40 which is inserted therein.

Figure 18:
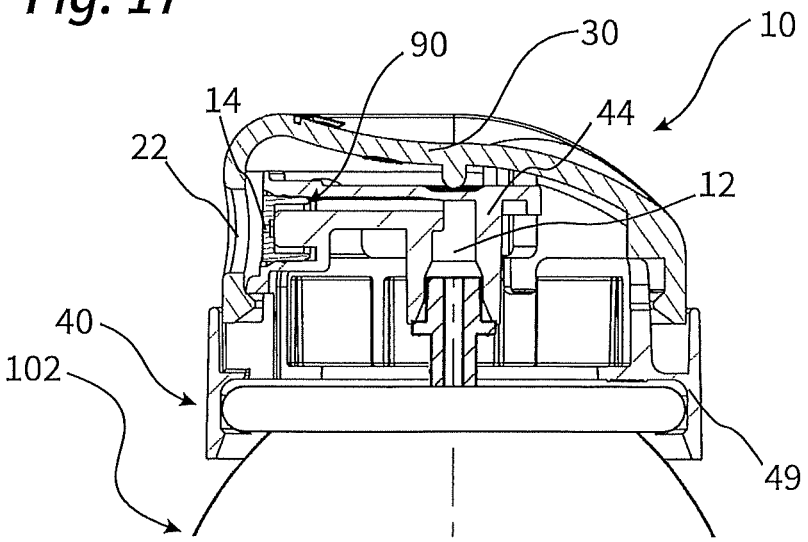
Figure 19:
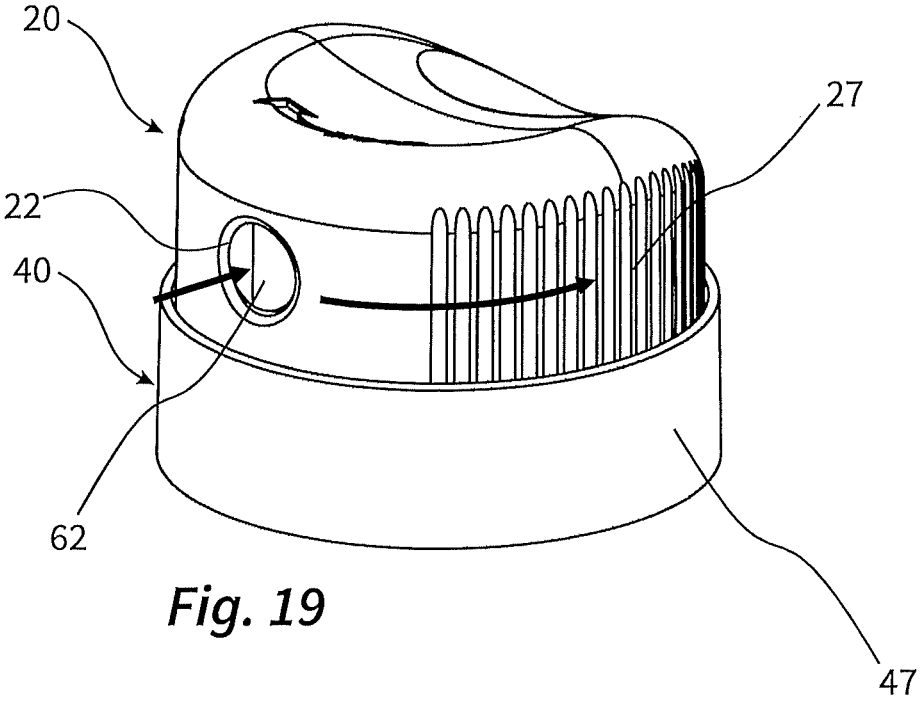
Figure 20:
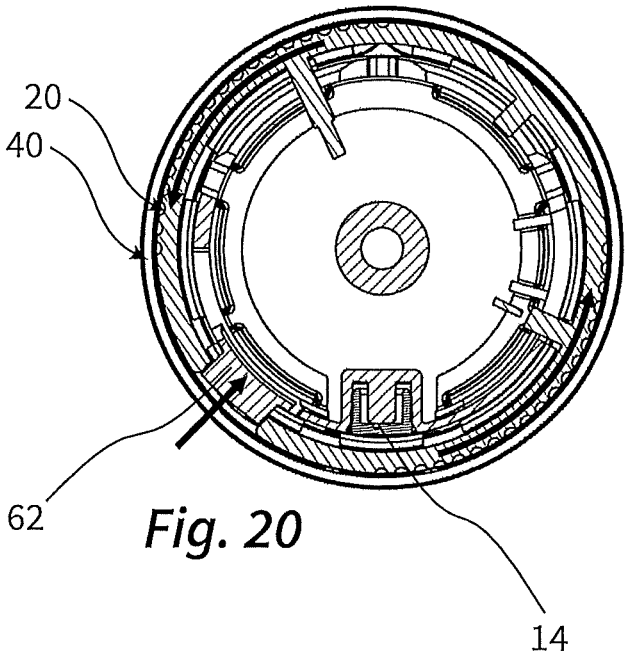

A first significant difference from the design in FIGS. 2 to 7D is that, in the design in FIGS. 17 to 22, the outer shell component 20 is of rotatable form, while the inner body 40 is at the same time that part of the discharge head 10 which is latched to the liquid reservoir 102. The inner body 40 has, for this purpose, latching means or a latching element 49 for fastening to the liquid reservoir 102, as can be seen in FIG. 18.

A further difference from the stated design in FIGS. 2 to 7D is that the angle between the discharge opening 14 and the release surface 62 is not 90°, but less, in the present case approximately 45°. In this way, the discharge head 10 can be displaced between the secured state and the released state with less effort. Owing to the fixing of the inner body 40 to the liquid reservoir 102, the relative rotational movement required for this purpose can be achieved in that the outer shell component 20 and the liquid reservoir 102 are gripped and the required mutually relative torque is exerted on said components. In order to facilitate this, provision is made on the outer shell component 20 of at least one grip surface 27, and in the present case, two grip surfaces 27 which are situated opposite one another.

This allows particularly good handlability. The user can grip the lateral surface of the outer shell component 20 with one hand in the region of the grip surface 27 and, with the same hand, press in the release surface 62, as is illustrated by the arrows in FIGS. 19 and 20, so that the rotational movement in relation to the liquid reservoir 102 and the inner body 40 and the outer surface 47 thereof is subsequently possible. In this way, said user transfers the discharge head from the secured state in FIGS. 19 and 20 into the state of use in FIGS. 21 and 22.

Figure 21:
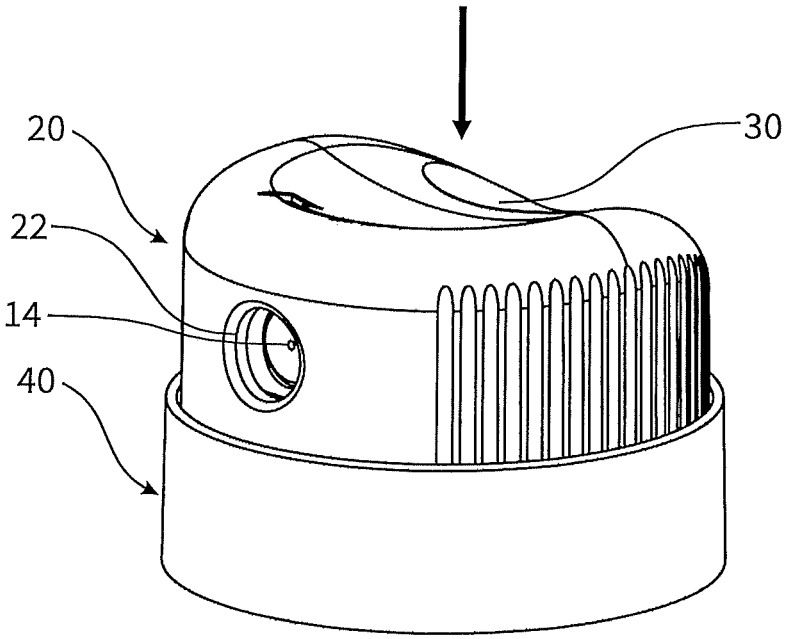
Figure 22:
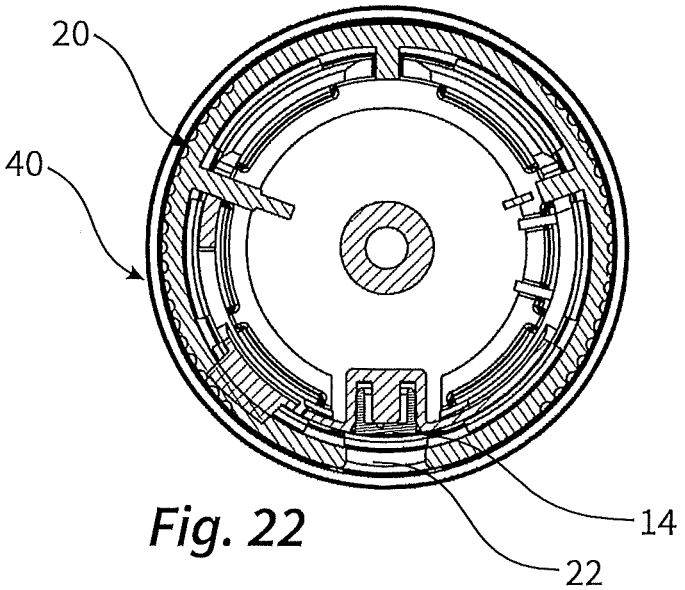

In the state of use, the manual actuation means or actuation member 30 of the outer shell component 20 can then be depressed in the manner indicated by the arrow in FIG. 21. Consequently, the line section 44 of the inner body 40 is, indirectly, also depressed, wherein an elastic deformation occurs because the surrounding components of the inner body 40, in particular the outer surface 47 thereof and the latching means 49, are not depressed along therewith.

The invention claimed is:

1. A discharge head for discharge of liquid, the discharge head comprising:

a discharge channel and a discharge opening at an end of the discharge channel;

an outer shell with a discharge aperture, wherein liquid delivered through the discharge opening is discharged through the discharge aperture;

the discharge head further comprising:

an inner body, the discharge opening being disposed on the inner body, the inner body being rotatable relative to the outer shell about a switching axis, wherein the discharge opening, in an open rotational position, is arranged in alignment with the discharge aperture of the outer shell and, in a closed rotational position, the discharge opening is covered by the outer shell, or a screen body arranged within the outer shell, the screen body being rotatable relative to the outer shell about a switching axis, wherein the screen body has a blocking section, the blocking section, in a closed rotational position, being arranged between the discharge opening and the discharge aperture in the outer shell and, in an open rotational position, the blocking section opening up the discharge aperture, the discharge head further comprising a releasable snap-action coupling including a release surface, the outer shell being rotationally coupled to the inner body or the screen body in the closed rotational position by the releasable snap-action coupling such that the open rotational position is reachable again only after manual application of force to the release surface of the releasable snap-action coupling, the releasable snap-action coupling further including an elastically radially inwardly deflectable latching extension projecting outwardly from the inner body or from the screen body, and a corresponding retaining aperture or retaining profiling on the outer shell, the retaining aperture of the outer shell being formed by the discharge aperture.

2. A liquid dispenser for discharge of liquids, comprising:

a liquid reservoir; and a discharge head, the discharge head comprising:

a discharge channel and a discharge opening at an end of the discharge channel;

an outer shell with a discharge aperture, wherein liquid delivered through the discharge opening is discharged through the discharge aperture; and an inner body, the discharge opening being disposed on the inner body, the inner body being rotatable relative to the outer shell about a switching axis, wherein the discharge opening, in an open rotational position, is arranged in alignment with the discharge aperture of the outer shell and, in a closed rotational position, the discharge opening is covered by the outer shell, or a screen body arranged within the outer shell, the screen body being rotatable relative to the outer shell about a switching axis, wherein the screen body has a blocking section, the blocking section, in a closed rotational position, being arranged between the discharge opening and the discharge aperture in the outer shell and, in an open rotational position, the blocking section opening up the discharge aperture, the discharge head further comprising a releasable snap-action coupling including a release surface, the outer shell being rotationally coupled to the inner body or the screen body in the closed rotational position by the releasable snap-action coupling such that the open rotational position is reachable again only after manual application of force to the release surface of the releasable snap-action coupling, the releasable snap-action coupling further including an elastically radially inwardly deflectable latching extension projecting outwardly from the inner body or from the screen body, and a corresponding retaining aperture or retaining profiling on the outer shell, the retaining aperture of the outer shell being formed by the discharge aperture.

3. The liquid dispenser according to claim 2, further comprising at least one of the following:

the liquid reservoir comprises a pressure reservoir; and/or the liquid reservoir has an outlet valve actuable by the inner body or by a conveying section attached to the outer shell.

4. The liquid dispenser according to claim 2, wherein:

the discharge head is connected to the liquid reservoir such that a separating force of 100 newtons is not sufficient to pull the discharge head off of the liquid reservoir; and/or separation of the discharge head and the liquid reservoir is possible only destructively.

5. The liquid dispenser according to claim 2, wherein:

the outer shell is connected rotationally conjointly to the liquid reservoir; or the inner body is connected rotationally conjointly to the liquid reservoir.

6. The discharge head according to claim 1, wherein the release surface comprises an end surface of the latching extension, and/or the retaining profiling is provided on a side of the outer shell which faces away from the discharge aperture, and/or the latching extension is provided on a radially deflectable surface section provided via a tangentially oriented deformation region on the inner body or the screen body, and/or on an inner side of the outer shell and/or on the latching extension an insertion bevel is provided by which the latching extension is deflected elastically radially inwardly when the inner body or the screen body is transferred relative to the outer shell into the closed rotational position.

* * * * *